US005967481A

United States Patent [19]

Lobo

[11] Patent Number: 5,967,481

[45] Date of Patent: Oct. 19, 1999

[54] STAGING COMPONENT MOUNTING SYSTEM

[76] Inventor: Gabriel Lobo, 162 NE. 23rd St., Miami, Fla. 33137

[21] Appl. No.: 08/888,208

[22] Filed: Jul. 3, 1997

[51] Int. Cl.[6] ..... E04H 12/06

[52] U.S. Cl. ..... 248/323; 52/650.3

[58] Field of Search ..... 248/323, 317, 248/318; 362/453, 403; 52/648.1, 650.3, 646

[56] References Cited

U.S. PATENT DOCUMENTS

| | | | |
|---|---|---|---|
| 1,204,044 | 11/1916 | McFaddin | 362/453 |
| 1,384,578 | 7/1921 | Tomlinson | 362/306 |
| 1,419,307 | 6/1922 | Richardson | 248/318 |
| 2,156,831 | 5/1939 | Andre | 482/66 |
| 3,120,403 | 2/1964 | Molzan et al. | 294/74 |
| 3,407,560 | 10/1968 | Baumann | 52/645 |
| 3,562,994 | 2/1971 | Linsowe | 52/650.2 |
| 4,512,117 | 4/1985 | Lange | 52/6 |
| 4,771,585 | 9/1988 | Onoda et al. | 52/646 |
| 4,858,867 | 8/1989 | King | 248/214 |
| 4,862,336 | 8/1989 | Richardson et al. | 362/285 |
| 5,361,565 | 11/1994 | Bayer | 254/292 |
| 5,743,060 | 4/1998 | Hayes et al. | 52/648.1 |

*Primary Examiner*—Ramon O. Ramirez
*Assistant Examiner*—Anita M. King
*Attorney, Agent, or Firm*—Malloy & Malloy, P.A.

[57] ABSTRACT

A staging component mounting system having a suspension assembly coupled to a support surface and including a first fastener element embedded in the support surface, and at least one elongate, strong, suspension segment coupled to an exterior coupling region of the first fastener element. The system further includes a primary truss that is strong, yet fully collapsible so as to facilitate storage and transportability thereof, and is removably coupled to the suspension assembly. The primary truss includes three elongate support members disposed in a spaced apart relation from one another, a brace element removably coupled between adjacent ones of the elongate support members in order to resist increased spacing of the adjacent support members from one another when coupled thereto, while also being structured to be removed from the coupled engagement so as to provide for collapsibility therebetween, and a plurality of removable fasteners structured to removably couple the brace element to the adjacent elongate support members. The system also includes an adjustable mount harness coupled to the suspension assembly and including a plurality of support segments coupled to an article to be mounted, and an adjustment segment variably coupled to each of the support segments so as to permit selective and independent modification of a mount elevation of the support segments and therefore a mount orientation of the article to be mounted.

34 Claims, 4 Drawing Sheets

STAGING COMPONENT MOUNTING SYSTEM

BACKGROUND OF THE INVENTION

1. Field of the Invention

The present invention relates to a staging component mounting system structured to facilitate the safe and adjustable mounting of various articles, such as speakers, lighting components, audio components and the like at a particular site. The system is structured to provide strong and secure mounting in a highly adaptable, adjustable, and cost-effective, manner that is also substantially collapsible, thereby permitting facilitated transport and storage of the staging component mounting system upon a change of venue or when full staging is not required.

2. Description of the Related Art

Various types of performance venues, such as theaters, arenas, concert halls and the like, as well as many other types of localities such as dance clubs and convention centers, often require the precise arrangement of lighting, speakers and other types of components. Typically, these various components are mounted to the ceiling in a variety of configurations in order to enhance the staging at the particular venue. Due, however, to the large volume of components and the often complex nature of their arrangement, in most circumstances, large hanging truss-type assemblies are pre-formed and mounted to the ceiling of the venue in a substantially permanent fashion. Accordingly, each subsequent show or performance at the venue will utilize the existing trusses for the mounting of its various components. Also, when the venue is not in use, or is in use for another purpose that does not require the assemblies, or when full staging is not required at a particular venue, the mount assemblies are generally lowered and stored at the venue, if storage space is available. Alternatively, however, some performances have very specialized set ups and/or utilize venues that do not have pre-installed mount assemblies, and as such, the large mount assemblies are owned or rented by the staging company putting on the performance such that they are merely taken down and shipped from one site to another when the particular show travels from venue to venue.

Of course, conventionally implemented mount assemblies have traditionally been designed to maximize strength, but to minimize weight. The reason for the maximization of strength relates to the heavy weight and large number of articles generally supported by the mount assembly. The desire to make the assembly light-weight, however, relates to the fact these mount assemblies must generally be transported as a solid assembly. Specifically, conventional mount assemblies are formed of aluminum tubing which has been welded together to define a preformed shape. As such, the large three dimensional shape of the formed mount assembly must be maintained during transport and storage. Naturally, this large and bulky configuration substantially increases the storage space required to contain the mount assemblies, as well as the amount of difficulties associated with transporting such a large, bulky, heavy item. Furthermore, it is noted that typically a plurality of the mount assemblies are included and must be stored and/or transported together.

As such, it would be highly beneficial to provide a staging component mounting system which is capable of supporting a large number of heavy components in an effective and adaptable manner, but which is also structured to be substantially easy to transport and store in a compact and manipulable manner. Such a system, however, should not compromise the requirements of strength and safety.

Additionally, it is often seen that in various staging situations a variety of articles, such as speakers and/or tweeters are suspended from ceiling mounted staging systems. Such systems, however, generally suspend the articles from preexisting hooks or mount points on the articles in a downward facing or side facing posture. Such mounting, however, does not take into account true positioning requirements of such components for normal or specialized uses, a particularly important consideration with audio tweeters and/or visual effects when an artistic and/or elaborate display and/or effects situation is to be generated. Indeed, most mounting systems do not provide for any adaptability or adjustability, but rather provide a single mounting position for all articles regardless of the particular nature of that article. Accordingly, it would also be highly beneficial to provide a staging component mounting system which is further configured to safely and securely mount various articles, but which is also adaptable to effectively mount those articles in an adjustable manner that appropriately orients a working face of the article in a variety of desired angles and orientations and a variety of directional postures in order to fully enhance the effect(s) sought to be generated.

SUMMARY OF THE INVENTION

The present invention is directed to a staging component mounting system to be utilized at various different types of venues, such as dance clubs and theaters, in order to effectively suspend and orient various articles such as lighting and audio components. Specifically, the staging component mounting system of the present invention includes at least one suspension assembly. The suspension assembly is structured to be coupled to a support surface, such as an overlying ceiling structure, and includes a first fastener element. The first fastener element is structured to be embedded in the support surface for substantially secure engagement therewith, and also includes an exterior coupling region. In particular, the exterior coupling region of the first fastener element is to remain exposed as a fastening point of the present system with the support surface. Moreover, the exterior coupling region is structured to be coupled with at least one elongate, strong suspension segment. The suspension segment, which includes a first end and a second end, is structured to be coupled to the exterior coupling region of the first fastener element at its first end and preferably extends downwardly therefor terminating at the second end of the suspension segment which is preferably coupled with other components of the staging component mounting system.

The system of the present invention further includes a primary truss. The primary truss is removably coupled to the suspension segment of the suspension assembly, preferably at the downwardly depending second end thereof. Furthermore, the primary truss is substantially strong, yet fully collapsible so as to facilitate transportability and storage thereof. Included as part of the primary truss are at least three elongate support members. The elongate support members are preferably disposed in a generally triangular orientation and are accordingly generally spaced apart from one another.

Disposed preferably between each adjacent pair of the elongate support members is a brace element. Specifically, the brace element is structured to be removably coupled to the adjacent elongate support members and is structured to resist increased spacing of the adjacent elongate support members from one another. As such, the strength and integrity of the primary truss in an assembled orientation is maintained by the brace elements. Additionally, however, each of the brace elements is also structured to be removed from its coupled engagement with at least one, but preferably both of the adjacent elongate support members to which it is coupled. As such, complete collapsibility therebetween can be achieved and collapsibility of the primary truss can effectuated. Further, a plurality of removable fasteners are preferably included and structured to removably couple the brace element to the adjacent elongate support members. Accordingly, the removable fasteners function to maintain the strong secure engagement of the brace elements when the primary truss is in an assembled orientation, while also permitting for disassembly by disengagement of the brace element from at least one of the adjacent support members to which it is coupled when compact storage and/or transport is required.

Also included as part of the staging component mounting system is an adjustable mount harness. The adjustable mount harness is structured to be coupled, either directly or indirectly through the primary truss, to the suspension assembly. Further, the adjustable mount harness includes a plurality of support segments, each of which includes a first end and a second end. The support segments are each structured to be coupled to an article to be mounted, at a second end thereof, so as to suspend the article to be mounted between all of the support segments. Additionally, the adjustable mount harness includes a plurality of adjustment segments. The adjustment segments are variably coupled to each of the support segments so as to permit selective and independent modification of a mount elevation of the second end of each of the support segments. In particular, one or more of the support segments may be raised or lowered relative to the suspension assembly as a result of the adjustment segment. As a result, a mounted orientation of the article to be mounted can be selectively modified and designed to meet the particular needs of a user.

It is an object of the present invention to provide a staging component mounting system which is completely collapsible so as to substantially facilitate transportability and storability thereof.

A further object of the present invention is to provide a staging component mounting system which is substantially strong and stable, while also being substantially portable.

Yet another object of the present invention is to provide a staging component mounting system which permits various articles to be mounted in precise mounting orientations, including precise angled orientations and directional postures.

A further object of the present invention is to provide a staging component mounting system which is substantially cost-effective to manufacture and implement.

Also an object of the present invention is to provide a staging component mounting system which is readily expandable, even while in place at a particular venue, in a substantially secure and safe manner.

These and other objects will become apparent upon reviewing the following detailed description and the accompanying claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
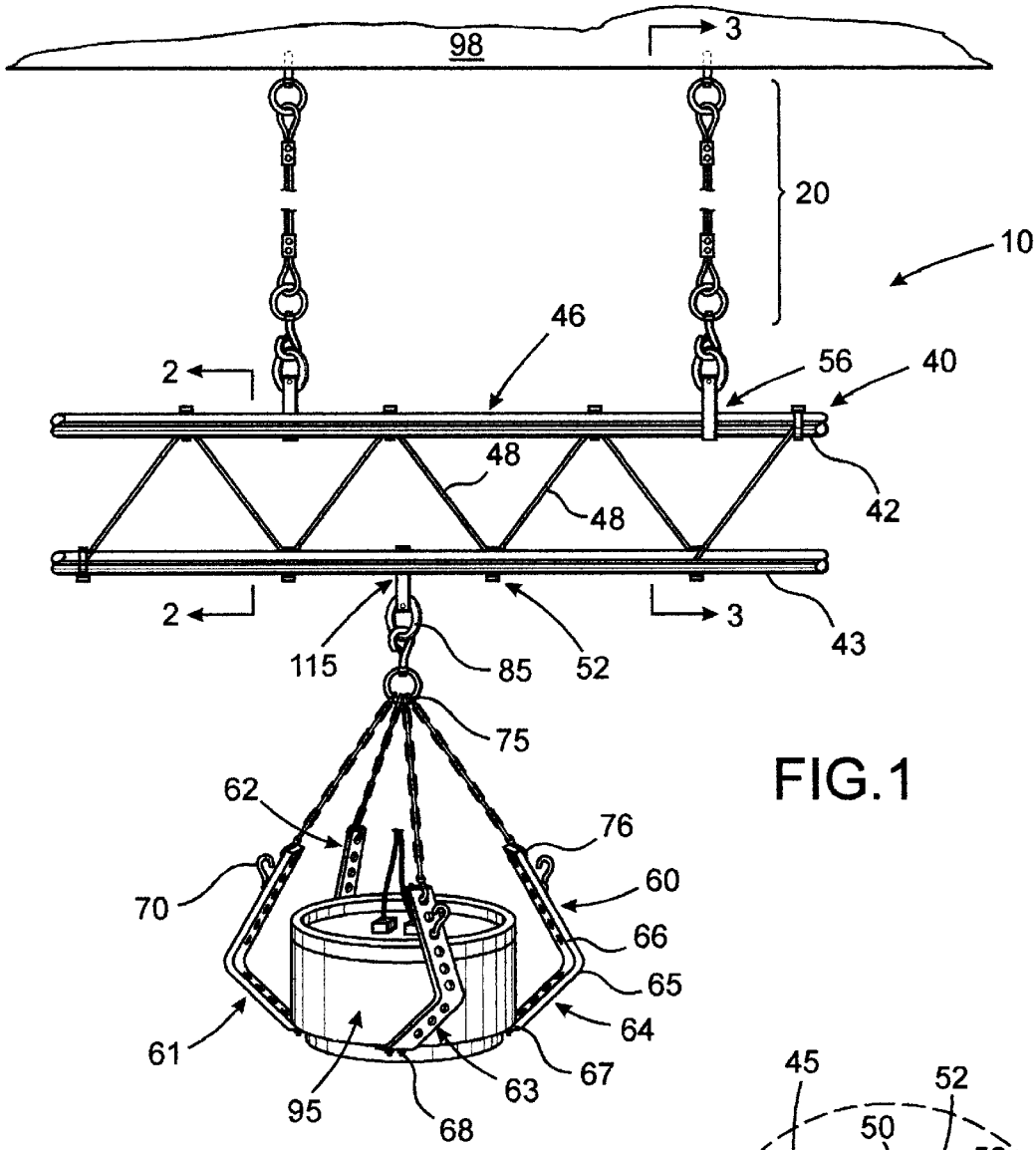
FIG. 1 is a front view of the staging component mounting system of present invention.

Shown throughout the Figures, the present invention is directed towards a staging component mounting system, generally indicated as 10. The staging component mounting system 10 is structured to safely and securely mount various components, such as speakers, audio tweeters 95, lights, etc., at a particular venue such as a theater, arena or dance club, and in a desired orientation and configuration to correspond the needs of that venue. Indeed, such venues typically include very high ceiling structures 98, which is the preferred support surface to which the staging component mounting system 10 is fastened, and thereby require a mounting system that provides for lowered mounting of the various components. Furthermore, if various visual and/or audio effects are to be achieved, the staging component mounting system 10 of the present invention is adaptable to achieve precise configurations and mount orientations by providing for the facilitated and adjustable mounting of a large variety of the components to be mounted in a quick and precisely adaptable manner that does not require a large number of mount points on the support surface 98.

Looking specifically to the staging component mounting system 10 of the present invention, it includes at least one suspension assembly 20. The suspension assembly 20 is structured to be coupled to the support surface 98 in a secure and substantially load bearing manner, and in the preferred embodiment a plurality of suspension assemblies 20 are included in order to disperse and balance the load to be suspended thereby. Also in the preferred embodiment, the suspension assembly 20 includes a first fastener element 22. The first fastener element 22 is structured to be embedded in the support surface 98, such as through a threaded region 23. Of course, any conventional anchoring structure can be incorporated in the first fastener element 22, depending upon the nature of the support surface 98, so long as a substantially secure, load bearing engagement is maintained. Additionally, the first fastener element 22 preferably includes an exterior coupling region 24. The exterior coupling region 24 remains exposed from the support surface 98 and provides an initial anchor point for the suspension assembly 20. In this regard, the suspension assembly 20 further includes at least one elongate, strong suspension segment 25.

Preferably the suspension segment 25 is generally flexible and is formed from a plurality of woven metal strands as is typically utilized in high-strength cables. The suspension segment 25 includes a first end 26 and a second end 28 and is sufficiently elongate so as to provide for the necessary lowering of the articles to be mounted. In particular, the first end 26 is structured to be coupled to the exterior coupling region 24 of the first fastener element 22 in a substantially secure manner. Preferably, however, the first end 26 of the suspension segment 25 is also structured to be removably secured to the first fastener element 22, such that when the system 10 of the present invention is not in use, only the first fastener element 22 can remain in place at the mount location.

In order to facilitate the secure, yet removable engagement of the first end 26 of the suspension segment 25 with the first fastener element 22, the suspension assembly 20 further includes a clamp member 27 disposed generally at the first end 26 of the suspension segment 25. Specifically, the first end 26 of the suspension segment 25 is structured to be looped through the first fastener element 22, with a free end of the first end 26 of the suspension segment 25 extending through the clamp member 27. Typically, the clamp member 27 is of the type which includes two adjustably spaced faces and has two channels wherethrough the suspension segment 25 may extend so as to define a loop. Once in place, the clamp member 27 is securely tightened and can include teeth or other gripping means therein in order to affirmative engage the suspension segment 25 and prevent slippage thereof to unfasten the loop. Moreover, adjustment of the position of the clamp member 27 can facilitate adjustment of a distance below the support surface to which the suspension segment 25 extends.

Figure 3:
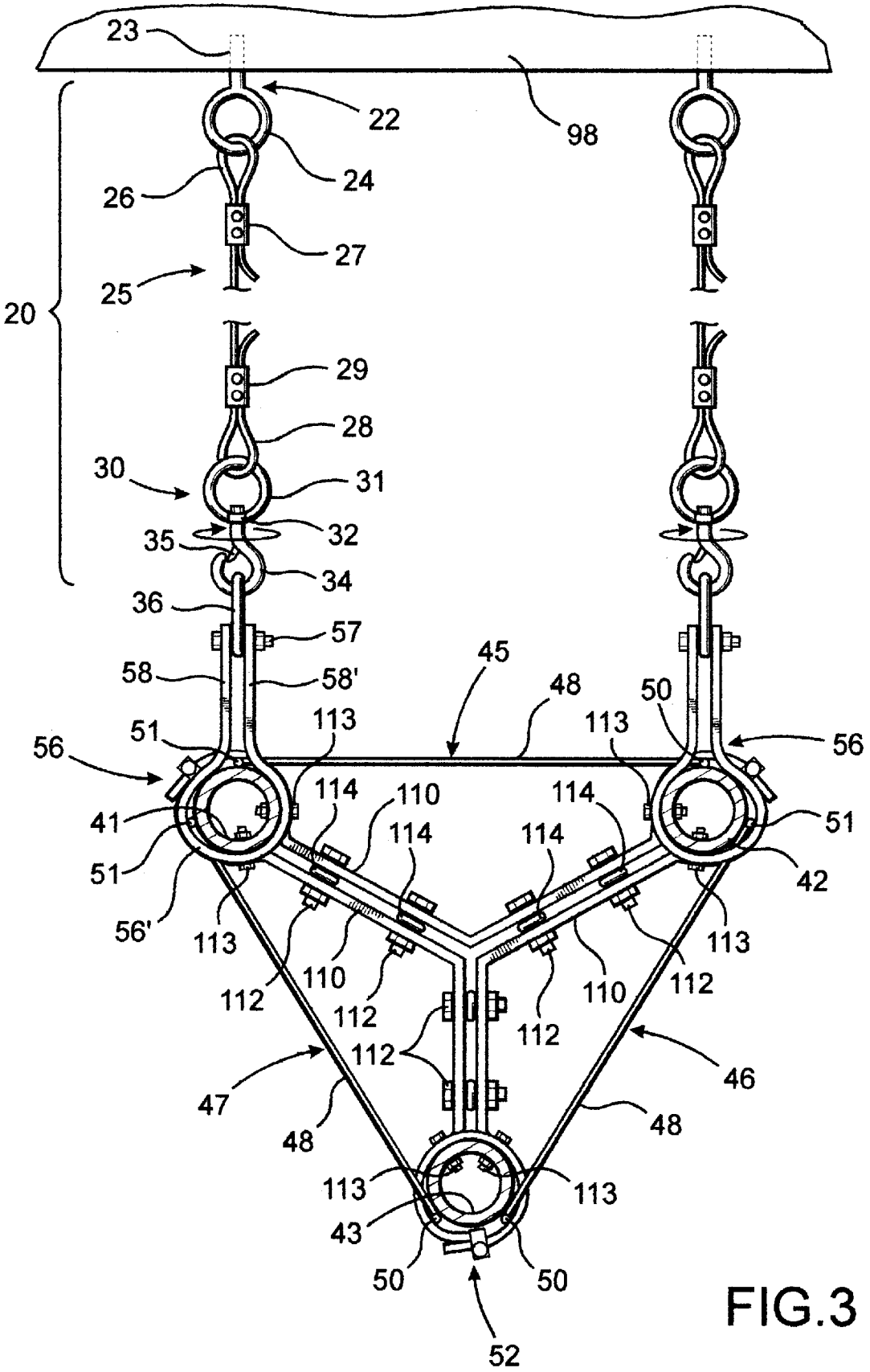
FIG. 3 is a cross section view along line 3—3 of FIG. 1 illustrating the suspension assembly of the present invention.

Similarly, the second end 28 of the suspension segment 25, which depends downwardly from the first fastener element 22, also has a loop defined therein by a clamp 29. The clamp member 29, much like the clamp member 27, securely engages the suspension segment 25 and defines the loop at the second end 28 of the suspension segment 25 in a removable fashion. Also in the preferred embodiment, as illustrated in FIG. 3, the suspension assembly 20 can further include a hook assembly 30 coupled at the second end 28 of the suspension segment 25. Specifically, the hook assembly 30 preferably includes a ring type region 31 which extends through the loop defined at the second end 28 of the suspension segment 25. Moreover, that ring region 31 includes a hub portion 32 wherethrough a hook 34 extends. Preferably, the hook 34 can swivel relative to the ring region 31 to accommodate a desired mount orientation. Furthermore, the hook 34 may be structured to include a biased closure flap 35 which permits the facilitated introduction of an element such as a fastening loop 36 into the hook 34, without providing for accidental removal of the hooked engagement unless the flap 35 is affirmatively opened. As such, temporary facilitated detachment from the hook 34 can be achieved if a user desires to maintain the suspension assembly 20 in place and secured to the support surface 98, while removing only the article which is supportably coupled thereto. Of course, the particular hardware elements which are incorporated in the suspension assembly can be varied as needed.

The staging component mounting system 10 further includes a primary truss, generally indicated as 40. The primary truss 40 is preferably structured to be removably coupled to the suspension segment 20 of the preferred embodiment previously recited. Furthermore, the primary truss 40 is structured to be substantially strong so as to support a large amount of weight thereon, yet to also be fully collapsible so as to facilitate storage and transportability thereof. In particular, the primary truss 40 will generally define a substantially large suspended structure from which other articles to be mounted may be suspended in a properly oriented and stable fashion. When, however, the primary truss 40 is to be removed from its suspended orientation, the primary truss 40 of the present invention is structured to be collapsed, preferably into all of its individual components, thereby substantially facilitating the transportability and/or storage of the primary truss when its use is not required.

Figure 2:
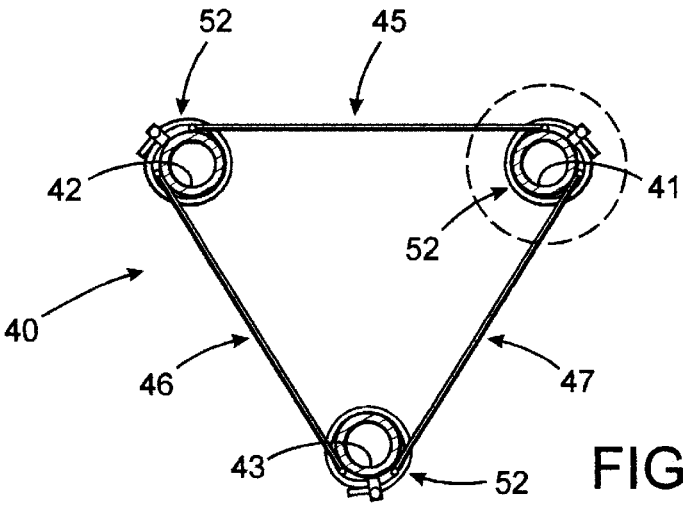
FIG. 2 is a cross section view along line 2—2 of FIG. 1, and including an enlarged detail portion illustrating the removable fasteners of the primary truss.
Figure 2A:
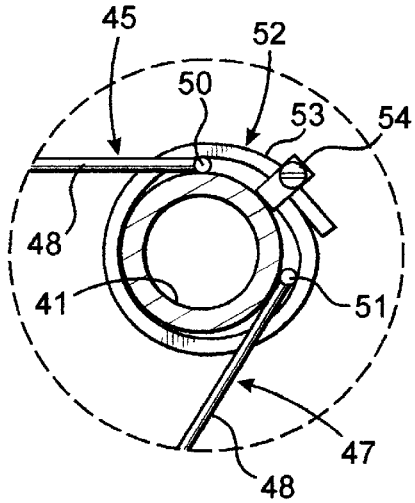
Figure 4:
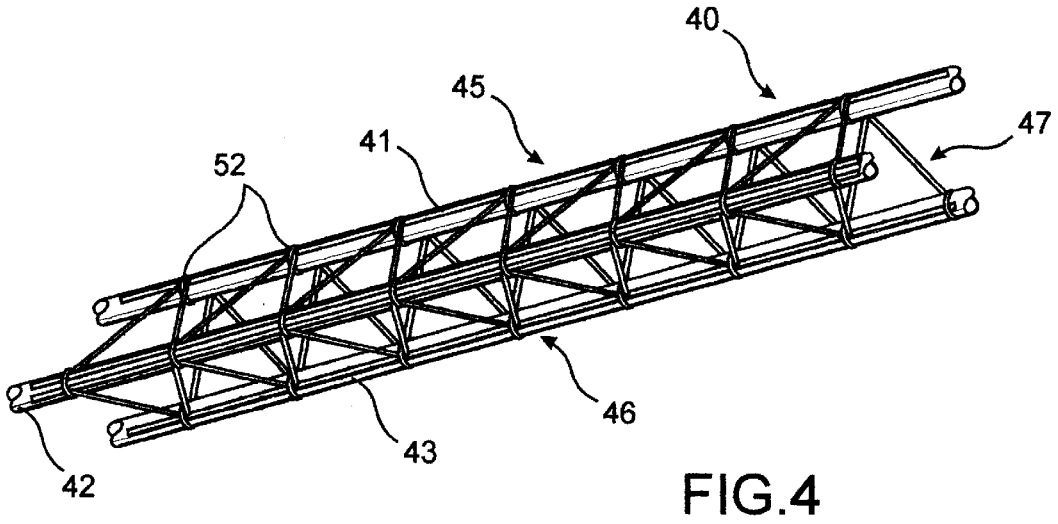
FIG. 4 is an isolated perspective view of the primary truss.

Turning to the preferred embodiment of the primary truss 40, it includes at least three elongate support members 41, 42 and 43. Specifically, in the preferred embodiment, the elongate support members 41, 42 and 43 are disposed in generally spaced apart relation from one another and define a generally triangular configuration, as best seen in FIGS. 2 and 4. Of course, however, if desired, more than three of the elongate support members could be incorporated so as to define a square, pentagon, or any other support configuration with each of the elongate support members preferably being disposed a spaced apart relation from one another and being secured with one another as will be described subsequently. Moreover, it is seen that the collapsibility of the primary truss 40 of the present invention enables a user to vary the number of elongate support member utilized to define the primary truss 40, either before or while suspended, according to the particular needs of a venue, either for support reasons or for aesthetic reasons. Also, in the preferred embodiment, the elongate support members 41, 42 and 43 will include generally elongate tubular members formed of steel or aluminum. Indeed, it may be preferred to form the elongate support members 41, 42 and 43 of steel due to its increased strength, the increased weight provided by the steel over conventionally implemented trusses being countered by the generally lightweight nature of the remaining assembly and its collapsible nature which does not require the entire truss 40 to be transported and/or moved as an integral unit.

Disposed between adjacent ones of the elongate support members 41, 42 and 43, are brace elements 45, 46 and 47. Specifically, each brace element 45, 46 and 47 is structured to be removably coupled to the adjacent elongate support members 41, 42 and 43, and is structured so as to generally resist increased spacing of the adjacent support member 41, 42 and 43 from one another when coupled thereto. In particular, as illustrated in the preferred embodiment, including three of the elongate support members 41, 42 and 43, it is seen that one of the brace elements 45, 46 and 47 generally spans the adjacent elongate support members 41, 42 and 43 so that one brace element is coupled to two elongate support members, and each elongate support member is coupled to two brace elements. It is noted that this configuration of one elongate support member coupled to two brace elements is the preferred configuration even when more than three of the elongate support members are incorporated, however, if desired and for added support, additional brace elements could be included for alternative interconnections between generally adjacent elongate support members. As such, upon a downward load being exerted on one of the support members from an article suspend by the primary truss 40, preferably at the elongate support members as will be described, the brace elements maintain the integrity of the primary truss 40 and prevent the loaded support members for separating from the remaining support members.

In addition to being substantially strong and resisting increased spacing of the adjacent support members 41, 42 and 43 from one another, the brace elements 45, 46 and 47 are also structured to be removed from their coupled engagement with at least one, but preferably from both, of the adjacent elongate support members 41, 42 and 43 to which they are coupled, As such, the removal of the brace elements 45, 46, and 47 from the elongate support members 41, 42 and 43 provides for substantial collapsibility therebetween. As indicated in FIG. 5, it is preferred that complete separation of all of the components of the primary truss 40 including all of the brace elements 45, 46 and 47 from all of the elongate support members 41, 42 and 43 be achieved to provide for maximum collapsibility, however, it is envisioned that if desired for convenience, only partial detachment can be achieved so long as generally flat type components remain, thereby still lessening a weight of each component and facilitating stacking and transport.

In the preferred embodiment, the brace elements 45, 46 and 47 are secured to the adjacent elongate support members 41, 42 and 43 by a plurality of removable fasteners 52. Although the removable fasteners 52 may take on any of a number of removable fastener type configurations that extend through or around the components, in the preferred embodiment the removable fasteners 52 include a generally elongate and strong material strip 53, such as a strip of metal, which is structured to extend around the brace elements and the support members, and the through a screw type fastener 54. Specifically, the screw type fastener 54, while it may take on any of a number of acceptable configurations, is preferably of the type which can be easily actuated so as to effectively tighten the clamping of the material strip 53 of the removable fastener 52 about the brace elements and the elongate support members to which the brace elements are secured, depending upon whether securement and/or detachment is desired. The preferred embodiment of the removable fastener 52 is best illustrated in FIG. 2.

Looking in further detail to the brace elements 45, 46 and 47 of the preferred embodiment, it is noted that each of the brace elements 45, 46 and 47 preferably includes a plurality of tension rods 48 coupled with one another and extending from one of the elongate support members to an adjacent one of the elongate support members. Moreover, while the adjacent tension rods 48 may be in directly coupled with one another through another article, it is preferred that the adjacent tension rods 48 be directly coupled with one another and be integrally formed with one another so as to define one continuous element having a generally zig-zag configuration to define that single integral rod. Additionally, it is also preferred that the brace elements 45, 46 and 47 each include at least one but preferably a pair of transverse support rods 50 and 51 which extend along a length of the brace elements 45, 46 and 47 at opposite sides thereof. Indeed, the transverse support rods 50 and 51 are structured to be coupled to the tension rods 48 and thereby define an entire one of the brace elements 45, 46 and 47 which can be removed and/or secured from its engagement with the elongate support members 41, 42 an 43 in its entirety. It is noted, that while the tension rods 48 define a single integral rod, it is preferred that the transverse support rods 50 and 51 be separate pieces securely coupled, directly to the tension rods 48, such as by welding, and that the secure coupling be effectuated at the joints and/or tension points 49 between the adjacent tension rods 48. Along these lines, it is seen that in the preferred embodiment the removable fasteners 52 are preferably disposed so as to couple the brace elements 45, 46 and 47 to the elongate support members 41, 42 and 43 at the tension rods 48, and preferably at the tension point 49 between adjacent tension rods 48. As such, any yeildability or bending to be exhibited by the brace elements 45, 46 and 47 is substantially minimized and a substantially secure, sturdy engagement to define the primary truss 40 can be achieved. Also, in the preferred embodiment the brace element 45, 46 and 47 are preferably formed of steel rods, the added weight provided by the steel rods being obviated by the collapsible nature of the truss assembly 40 and the generally small diameter which can be effectively utilized.

Figure 5:
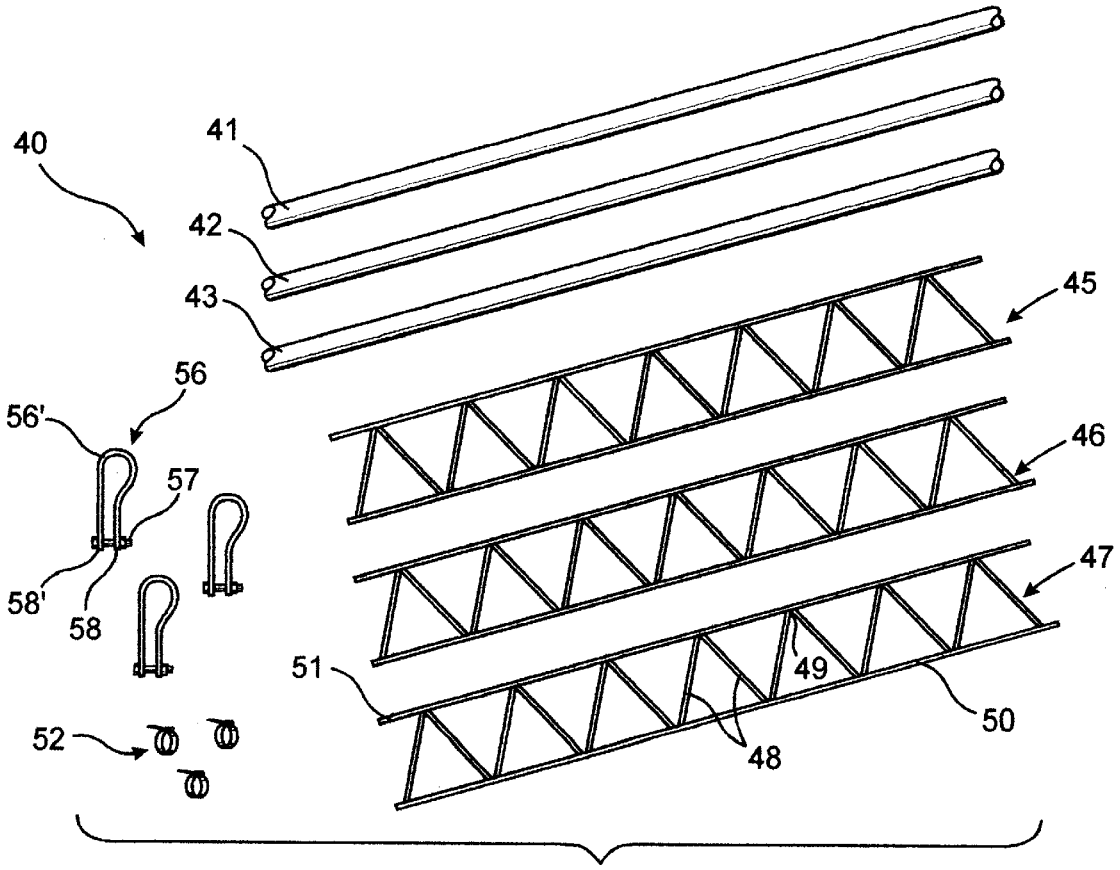
FIG. 5 is a disassembled view of the primary truss.

Turning to FIGS. 3 and 5, it is noted that a plurality of retention segments 56 are also preferably included and structured and disposed so as to removably couple the primary truss 40 to the suspension assembly 20. Specifically, the retention segments 56 are structured to extend about one of the elongate support members 41, 42 and 43 in order to removably couple the primary truss 40 to the suspension segment 25 of the suspension assembly 20, at generally the second end 28 of the suspension segment 25. As to the number and positioning of the retention segments 56, it is seen that preferably only the upper elongate support members 41 and 42 need be secured to one or more of the suspension assemblies 20 so as to provide for effective securement of the primary truss 40, and two or more of the retention segments 56 may be disposed along a length of each of the elongate support members 41 and 42 as deemed appropriate for effective coupling and securement.

Looking to the preferred embodiment of the retention segments 56, preferably each retention segment 56 includes a material strip 56' that terminates in a pair of free ends 58 and 58'. Indeed the material strip 56' extends about the elongate support member 41 and 42, and indeed about the brace element secured to the elongate support member. Moreover, as illustrated in the Figures, the free ends 58 and 58' of the material strip 56' of the retention segments 56 are structured to be coupled with one another by a fastener element 57, such as an elongate bolt, that extends therethrough. The fastener element 57, referring to the previously illustrated preferred embodiment of the suspension assembly 20, can extend through the fastening loop 36 to provide an axis upon which the retention segment 56 is suspended. Moreover, the fastener element 57 can be easily removed in order to un-couple the retention segment 56 from the elongate support member to which it is coupled. Such removability, in addition to aiding with the entire collapsibility of the primary truss 40 is of particular benefit if wiring or other types of components must be extended through or along the primary truss 40, as a single one of the retention segments 56 can be independently removed while the remaining retention segments 56 maintain the primary truss 40 securely suspended.

Referring to FIG. 3, it is also noted that in a preferred embodiment of the staging component mounting system 10 of the present invention, the primary truss 40 further includes at least one, but preferably three to correspond a number elongate support members, compression supports 110. The compression supports 110 are structured and disposed to resist compression of the elongate support members 41, 42 and 43 towards one another when subjected to a substantial load, thereby further adding to the strength and stability of the primary truss 40. As such, the compression supports 110 are preferably substantially rigid and are coupled between, and preferably to adjacent elongate support members 41, 42 and 43, as illustrated in FIG. 3. Moreover, it is seen that in the preferred embodiment, the compression supports 110 preferably include a generally angled configuration. Accordingly, the compression supports 110 can be coupled both to the elongate support members 41, 42 and 43, such as through fasteners 113, and to one another, such as through a series of elongate fasteners 112 and spacers 114, to provide for substantially increased stability and to provide for an increase of a compressive resistance thereof. Of course, one or more sets of the compression supports 110 may be incorporated as necessary or as desired, and the particular angular configuration of the compression supports 110 may be modified or expanded depending upon the configuration of the elongate support members 41, 42 and 43 relative to one another.

Preferably removably disposed about one of the elongate support members, such as the lowermost elongate support member 43, are one or more removable truss clamps 115. Specifically, one ore more of the removable truss clamps 115 extend about all or some of the elongate support members, depending on the particular needs of the venue, in order to couple one or more of the articles to be mounted thereto. In the preferred embodiment, the truss clamp 115, includes a looped material strip type configuration which extends about the elongate support members and has a securement member 116 to clamp the truss clamp 115 in place and provide an axis for the suspension of an article therefrom. In this regard, an additional suspension segment may be incorporated and extended from the truss clamp 115, or any other article such as a loop 85 may be coupled to the truss clamp 115 in order to provide for the effective securement of the article to be mounted therefrom. Along these lines, while a conventional mounting system, such as merely a flexible segment bolted to the article to be mounted may be utilized and secured to the truss clamp 115, in the preferred embodiment illustrated in FIG. 7, an adjustable mount harness 60 is preferably incorporated as part of the staging component mounting system 10 of the present invention and can be mounted to the truss clamp 115.

Figure 6:
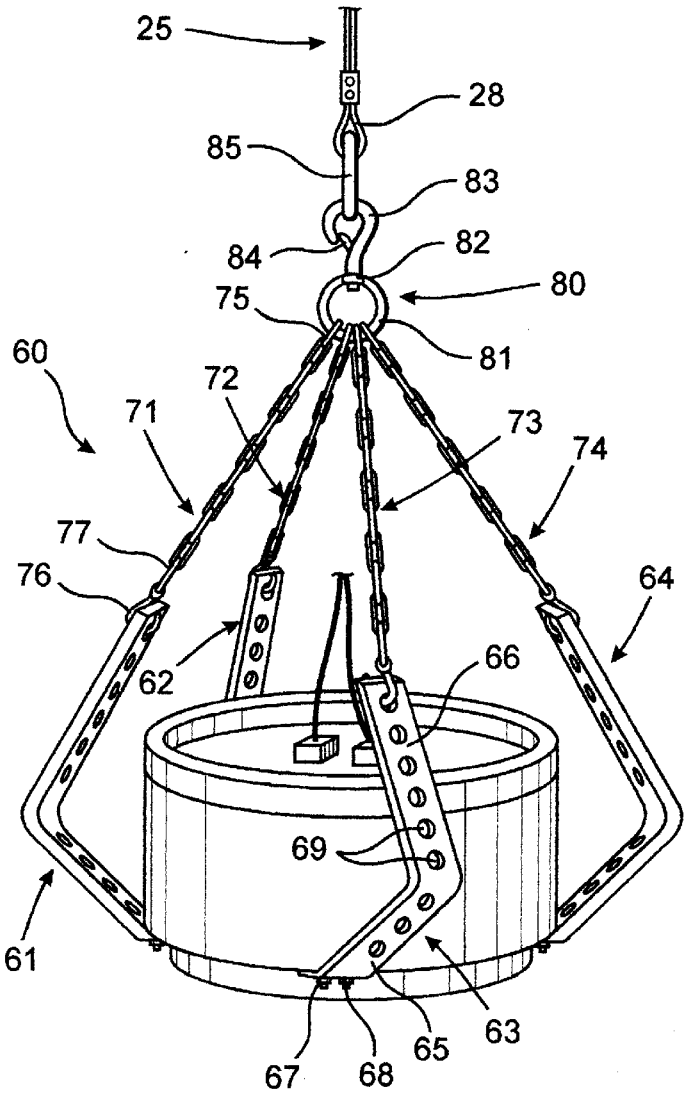
FIG. 6 is an isolated view of an embodiment of an embodiment of the adjustable mount harness of the present invention.
Figure 7:
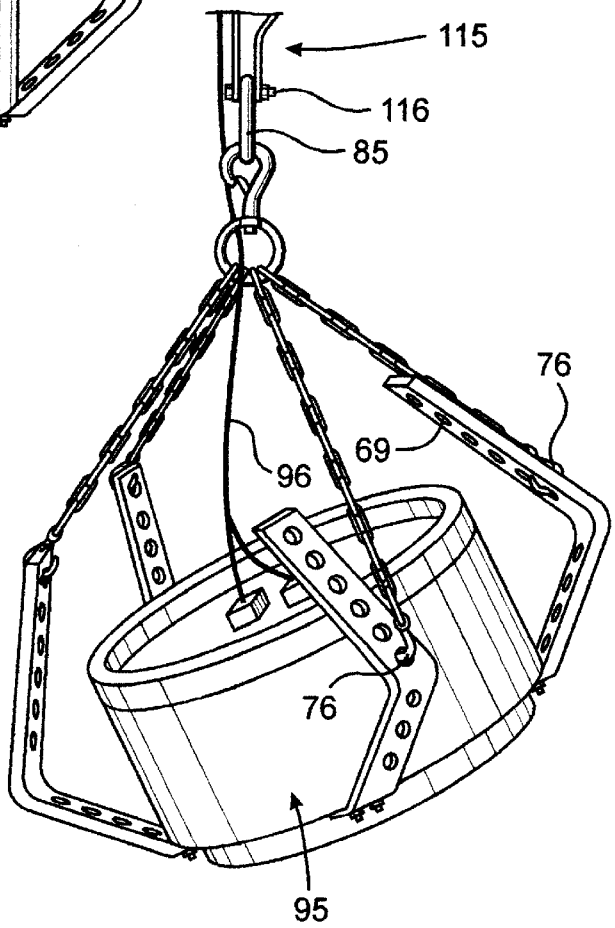
FIG. 7 is an isolated view of the adjustable mount harness of the present invention illustrating indirect coupling to the suspension assembly via the primary truss, and illustrating a modified mounted orientation of the article to be mounted utilizing the preferred embodiment of the adjustable mount harness.

Specifically, the adjustable mount harness 60 is structured to be coupled to the suspension assembly 20 of the present invention. This coupling to the suspension assembly 20 may be direct coupling, as illustrated in FIG. 6, or may be indirect coupling via the primary truss 40, as illustrated in FIGS. 1 and 7. Moreover, the adjustable mount harness 60 of the present invention preferably includes a plurality of support segments 61, 62, 63 and 64. The support segments 61, 62, 63 and 64, each include generally a first end 66 and a second end 65, and are coupled to the article to be mounted 95 at generally the second end 65 thereof. Also, preferably each of the support segments 61, 62, 63 and 64 are disposed in a spaced apart distance from one another and thereby suspend the article to be mounted 95 therebetween without blocking a primary operating face of the article 95. Indeed, each of the support segments preferably includes an angular configuration defined between the first and second ends 65 and 66 thereof. As such, spacing between the support segments 61, 62, 63 and 64, and the article to be mounted 95, can be maintained during a full range of mounted movement thereof, as will be described and as illustrated in FIGS. 6 and 7. Moreover, in the preferred embodiment, the second end 65, of each of the support segments 61, 62, 63 and 64 further includes a mount lip 67. The mount lip 67 is structure to be secured to the article 95 to be mounted such as through a fastener bolt 68, and typically the lip 67 is structured to engage normal mount points of the article 95 to be mounted in a conventional manner, thereby providing for conventional planar mounting.

The adjustable mount harness 60 further includes an adjustment segment 71, 72, 73 and 74 coupled to each of the support segments 61, 62, 63 and 64. Specifically, the adjustment segments 71, 72, 73 and 74 are structured to permit selective and independent modification of a mount elevation of the second end 65 of each of the support segments 61, 62, 63 and 64, and thereby provides for selective and independent modification of a mounted orientation of the article 95 to be mounted. In a first embodiment of the adjustable mount harness 60, as illustrated in FIGS. 6 and 7, the adjustment segments 71, 72, 73 and 74 are structured to be adjustably coupled to the first ends 66 of the support segments 61, 62, 63 and 64 at variable points along a length of the support segments 61, 62, 63 and 64. Specifically, the adjustment segments 71, 72, 73 and 74 of this embodiment preferably include a hook-type element 76 at an end 77 thereof. The hook 76 is structured to extend through one of a plurality of apertures 69 or loops or mating hooks, disposed at the variable points along a length of the support segments 61, 62, 63 and 64. Indeed, these apertures 69 may extend along to the second end 65 of the support segments 61, 62, 63 and 64 depending on the particular mount orientation needs. As such, as seen in FIGS. 6 and 7, conventional mounting which aims in operating face of the article 95 to be mounted straight down is achieved by placing the hooks 76 through an uppermost aperture 69 of the support segments 61, 62, 63 and 64, but by selectively adjusting the position of the hooks 76 in one or preferably two of the support segments 63 and 64, however, the mount orientation of the article 95 is changed to an angle, such as the 45 degree angle depicted in FIG. 7. Indeed, it is seen that providing the mounting at such an angled orientation substantially increases an effect that can be achieved. Also, looking to FIG. 1, it is also noted that in an alternative, preferred embodiment, the first ends 66 of the support segments 61, 62, 63 and 64 may be structured to be adjustably coupled to the adjustment segments 71, 72, 73 and 74 at variable points along a length thereof. In this embodiment, the adjustment segments 71, 72, 73 and 74 each include a plurality of mount apertures or mount points extending along a length thereof, with the support segments 61, 62, 63 and 64 including a hook element 70 structured to adjustably engage one of the mount apertures to define the desired mount posture. Also, in this as well as the other embodiment, and end of the adjustment segments 71, 72, 73 and 74 preferably remains coupled to the first ends 66 of the support segments 61, 62, 63 and 64, while still providing for adjustable hooking to change the mount posture. As such, it is preferred that the adjustment segments 71, 72, 73 and 74 each comprise a general flexible chain, each link of the chain defining one of the mount apertures in the second embodiment.

Additionally, looking to FIGS. 6 and 7, the adjustment segments 71, 72, 73 and 74 are preferably secured to a coupling assembly 80. In particular, an upper end 75 of each of the adjustment segments 71, 72, 73 and 74, preferably extends into and is coupled with the coupling assembly, such as at a ring portion 81 thereof. Moreover, in the preferred embodiment the coupling assembly 80 includes a ring portion 81 with a hub 82 through which a hook element 83 extends. The hub 82 is structured to provide for swivelability of the ring portion 81 relative to the hook 83, thereby permitting rotation of the plurality of support segment 71, 72, 73 and 74, and thereby the article 95 to be mounted, into a desired directional posture merely by rotating the coupling assembly 80. In this regard, it is seen that a braking or stopper element may be included so as to prevent further rotation when a desired directional posture is attained, and as illustrated in the Figures, a biased lock element 84 may be provided so as to facilitate hooking retention of the hook element 83 at a mount point such as the loop 85, shown in FIGS. 6 and 7. Along these lines, it is noted that the preferred loop 85 may be structured to be coupled directly with the suspension assembly 20, such as at the second end 28 of the suspension segment 25, or the loop 85 may be coupled to a truss clamp 115 depending upon whether the adjustable mount harness 60 is to be coupled directly to the suspension assembly 20 or indirectly to the suspension assembly 20. Further, as to the general wiring 96 of the article 95, that can, of course, be threaded through the various articles and components which are utilized to suspend the article 95.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A staging component mounting system comprising:

(a) at least one suspension assembly, said suspension assembly being coupled to a support surface and comprising:

a first fastener element, said first fastener element structured to be embedded in the support surface and including a exterior coupling region, and at least one elongate, strong suspension segment, said suspension segment including a first end coupled to said exterior coupling region of said first fastener element, and a generally downwardly depending second end;

(b) a primary truss, said primary truss being substantially strong, yet fully collapsible so as to facilitate storage and transportability thereof;

said primary truss being removably coupled to said suspension segment of said suspension assembly and comprising:

at least three elongate support members, said support members being disposed in generally spaced apart relation from one another, a brace element disposed between adjacent ones of said elongate support members, said brace element being removably coupled to said adjacent elongate support members and being structured to generally resist increased spacing of said adjacent support members from one another when coupled thereto, while also being structured to be removed from said coupled engagement with at least one of said adjacent elongate support members so as to provide for collapsibility therebetween, and a plurality of removable fasteners structured to removably couple said brace element to said adjacent elongate support members; and (c) an adjustable mount harness, said adjustable mount harness being coupled to said suspension assembly and comprising:

a plurality of support segments, each of said support segments including a first end and a second end and being coupled to an article to be mounted at said second end so as to suspend the article to be mounted between said support segments; and an adjustment segment variably coupled to each of said support segments so as to permit selective and independent modification of a mount elevation of said second end of each of said support segments, thereby selectively modifying a mounted orientation of the article to be mounted.

2. A staging component mounting system as recited in claim 1 wherein said brace element includes a plurality of tension rods coupled with one another and extending from one of said elongate support members to said adjacent elongate support member, said brace element being coupled to said adjacent elongate support members by said removable fasteners generally at said tension rods so as to increase stability and strength.

3. A staging component mounting system as recited in claim 2 wherein said tension rods of said brace element are directly coupled with one another in a generally zig-zag type configuration and define a single integral rod.

4. A staging component mounting system as recited in claim 2 wherein said brace element further includes a pair of transverse support rods extending along a length of said brace element, at opposite sides thereof, said transverse support rods being coupled to said tension rods so as to define an entire one of said brace elements, said entire brace element being at least partially removable from said coupled engagement with said adjacent elongate support members by disengagement of said removable fasteners.

5. A staging component mounting system as recited in claim 4 wherein said tension rods of said brace element are coupled with one another in a generally zig-zag type configuration.

6. A staging component mounting system as recited in claim 1 further including a plurality of retention segments structured to extend about one of said elongate support members so as to removably couple said primary truss to said suspension segment of said suspension assembly at generally said second end thereof.

7. A staging component mounting system as recited in claim 6 including a plurality of said suspension assemblies structured to suspend said primary truss.

8. A staging component mounting system as recited in claim 7 wherein each of said retention segments is independently removable so as to permit disengagement of said primary truss from one of said suspension assemblies while maintaining secured, coupled engagement of said primary truss with remaining ones of said suspension assemblies.

9. A staging component mounting system as recited in claim 8 wherein each of said suspension assemblies includes a clamp member disposed generally at said second end of said suspension segment so as to define a loop at said second end of said suspension segment, said loop being structured to removably receive one of said retention segments therethrough.

10. A staging component mounting system as recited in claim 1 wherein said primary truss further includes at least one compression support structured to resist compression of said elongate support members towards one another.

11. A staging component mounting system as recited in claim 10 including three of said compression supports, each of said compression supports being substantially rigid and coupled between said adjacent elongate support members.

12. A staging component mounting system as recited in claim 11 wherein said compression supports include a generally angled configuration and are structured to be coupled with one another so as to increase a compressive resistance thereof.

13. A staging component mounting system as recited in claim 1 further including a plurality of removable truss clamps structured to be removably disposed about one of said elongate support members and structured to be coupled to one of said articles to be mounted.

14. A staging component mounting system as recited in claim 13 wherein said adjustable mount harness is structured to be removably coupled to one of said truss clamps.

15. A staging component mounting system as recited in claim 1 wherein said brace elements are formed of steel.

16. A staging component mounting system as recited in claim 1 wherein said elongate support members include a generally tubular configuration.

17. A staging component mounting system as recited in claim 1 wherein said elongate support members are disposed in a generally triangular configuration.

18. A staging component mounting system as recited in claim 1 wherein said adjustable mount harness further includes a coupling assembly structured to adjustably couple said adjustment segments to said suspension segment of said suspension assembly.

19. A staging component mounting system as recited in claim 18 wherein said coupling assembly is structured to swivel so as to permit rotation of said plurality of support segments and accordingly the article to be mounted into a desired directional posture.

20. A staging component mounting system as recited in claim 19 wherein each of said suspension assemblies includes a clamp member disposed generally at said second end of said suspension segment so as to define a loop at said second end of said suspension segment, said loop being structured to removably receive said coupling assembly therethrough.

21. A staging component mounting system as recited in claim 1 wherein said plurality of support segments include a generally angular configuration structured to maintain spacing from said article to be mounted and thereby increase a range of mounted movement thereof, and said second end of each of said support segments includes a mount lip structured to be secured to the article to be mounted.

22. A staging component mounting system as recited in claim 21 wherein said first end of said support segments is structured to be adjustably coupled to said adjustment segment at variable points along a length thereof.

23. A staging component mounting system as recited in claim 22 wherein said first end of said support segment includes a hook element, said hook element being structured to selectively extend through one of a plurality of mount apertures in said adjustment segment.

24. A staging component mounting system as recited in claim 23 wherein said adjustment segment includes a generally flexible chain.

25. A staging component mounting system as recited in claim 21 wherein said adjustment segment is structured to be adjustably coupled to said first end of said support segments at variable points along a length thereof.

26. A staging component mounting system comprising:

(a) at least one suspension assembly, said suspension assembly being coupled to a support surface;

(b) a primary truss, said primary truss being substantially strong, yet fully collapsible so as to facilitate storage and transportability thereof;

said primary truss being removably coupled to said suspension assembly and comprising:

at least three elongate support members, said support members being disposed in generally spaced apart relation from one another, a brace element disposed between adjacent ones of said elongate support members, said brace element being removably coupled to said adjacent elongate support members and being structured to generally resist increased spacing of said adjacent support members from one another when coupled thereto, while also being structured to be removed from said coupled engagement with at least one of said adjacent elongate support members so as to provide for collapsibility therebetween, said brace element including a plurality of tension rods coupled with one another and extending from one of said elongate support members to said adjacent elongate support member, a plurality of removable fasteners structured to removably couple said brace element to said adjacent elongate support members at said tension rods so as to increase a stability and strength of said brace element.

27. A staging component mounting system as recited in claim 26 wherein said brace element further includes a pair of transverse support rods extending along a length of said brace element, at opposite sides thereof, said transverse support rods being coupled to said tension rods so as to define an entire one of said brace elements, said entire brace element being at least partially removable from said coupled engagement with said adjacent elongate support members by disengagement of said removable fasteners.

28. A staging component mounting system as recited in claim 27 wherein said tension rods of said brace element are coupled with one another in a generally zig-zag type configuration and define a single integral rod.

29. A staging component mounting system as recited in claim 26 wherein said suspension assembly comprises:

a first fastener element, said first fastener element structured to be embedded in the support surface and including a exterior coupling region, and at least one elongate, strong, suspension segment, said suspension segment including a first end coupled to said exterior coupling region of said first fastener element, and a generally downwardly depending second end.

30. A staging component mounting system as recited in claim 29 further including a plurality of retention segments structured to extend about one of said elongate support members so as to removably couple said primary truss to said suspension segment of said suspension assembly at generally said second end thereof.

31. A staging component mounting system as recited in claim 30 including a plurality of said suspension assemblies structured to suspend said primary truss.

32. A staging component mounting system as recited in claim 31 wherein each of said retention segments is independently removable so as to permit disengagement of said primary truss from one of said suspension assemblies while maintaining secured, coupled engagement of said primary truss with remaining ones of said suspension assemblies.

33. A staging component mounting system comprising:

(a) at least one suspension assembly, said suspension assembly being coupled to a support surface;

(b) a primary truss, said primary truss being substantially strong, yet fully collapsible so as to facilitate storage and transportability thereof;

said primary truss being removably coupled to said suspension assembly and comprising:

at least three elongate support members, said support members being disposed in generally spaced apart relation from one another, a brace element disposed between adjacent ones of said elongate support members, said brace element being removably coupled to said adjacent elongate support members and being structured to generally resist increased spacing of said adjacent support members from one another when coupled thereto, while also being structured to be removed from said coupled engagement with at least one of said adjacent elongate support members so as to provide for collapsibility therebetween, said brace element including a plurality of tension rods coupled with one another and extending from one of said elongate support members to said adjacent elongate support member, a plurality of removable fasteners structured to removably couple said brace element to said adjacent elongate support members at said tension rods so as to increase a stability and strength of said brace element, and said brace element further including a pair of transverse support rods extending along a length of said brace element, at opposite sides thereof, said transverse support rods being coupled to said tension rods so as to define an entire one of said brace elements, said entire brace element being at least partially removable from said coupled engagement with said adjacent elongate support members by disengagement of said removable fasteners.

34. A staging component mounting system comprising:

(a) at least one suspension assembly, said suspension assembly being coupled to a support surface;

(b) a primary truss, said primary truss being substantially strong, yet fully collapsible so as to facilitate storage and transportability thereof;

said primary truss being removably coupled to said suspension assembly and comprising:

at least three elongate support members, said support members being disposed in generally spaced apart relation from one another, a brace element disposed between adjacent ones of said elongate support members, said brace element being removably coupled to said adjacent elongate support members and being structured to generally resist increased spacing of said adjacent support members from one another when coupled thereto, while also being structured to be removed from said coupled engagement with at least one of said adjacent elongate support members so as to provide for collapsibility therebetween, said brace element including a plurality of tension rods coupled with one another and extending from one of said elongate support members to said adjacent elongate support member, a plurality of removable fasteners structured to removably couple said brace element to said adjacent elongate support members at said tension rods so as to increase a stability and strength of said brace element, and said tension rods of said brace element being coupled with one another in a generally zig-zag type configuration and defining a single integral rod.

* * * * *